US006079157A

United States Patent [19]

Hincher, Sr.

[11] Patent Number: 6,079,157

[45] Date of Patent: Jun. 27, 2000

[54] ILLUMINATED SECURITY BARRIER FOR PASSAGEWAYS

[76] Inventor: William Matthew Hincher, Sr., 23 Pittenger Pond Rd., Freehold, N.J. 07728

[21] Appl. No.: 09/249,293

[22] Filed: Feb. 12, 1999

[51] Int. Cl.[7] ..... E06B 3/68

[52] U.S. Cl. ..... 49/57; 49/55; 49/463; 49/25; 362/152

[58] Field of Search ..... 49/51, 50, 55, 49/465, 466, 463, 199, 25; 160/10, 210, 215, 220, 225; 362/133, 147, 152, 394, 802

[56] References Cited

U.S. PATENT DOCUMENTS

| | | | |
|---|---|---|---|
| 3,867,621 | 2/1975 | Gewfrtz | 362/147 X |
| 4,520,592 | 6/1985 | Holloway | 49/25 X |
| 5,396,732 | 3/1995 | Andersen | 49/55 |
| 5,437,115 | 8/1995 | Freese et al. . | |
| 5,457,914 | 10/1995 | Johnson, Jr. . | |
| 5,532,560 | 7/1996 | Element et al. | 49/25 X |
| 5,535,552 | 7/1996 | Stern . | |
| 5,782,036 | 7/1998 | Bertieri et al. | 49/25 |
| 5,809,694 | 9/1998 | Postans . | |
| 5,867,099 | 2/1999 | Keeter | 362/394 X |
| 5,887,856 | 3/1999 | Everly, II | 362/152 X |

*Primary Examiner*—Daniel P. Stodola
*Assistant Examiner*—Hugh B. Thompson
*Attorney, Agent, or Firm*—Terrrance L. Siemens

[57] ABSTRACT

An illuminated safety or security barrier is shown for preventing children and pets from gaining unauthorized access through passageways. The barrier may optionally be a gate allowing authorized passage. The barrier includes an electrically operated light disposed to illuminate the barrier directly, to project a visible signal away from the barrier, or both. The barrier includes an electrical system having a battery or plug and cord to supply power, controls, and conductors connecting the light, power source, and controls. Optionally, the controls include a programmable timer or a photocell or a motion sensor to inhibit operation of the light, and a manual switch which controls intensity of the light. The various controls may be combined if desired. Optionally, a remote controller is provided.

11 Claims, 2 Drawing Sheets

ILLUMINATED SECURITY BARRIER FOR PASSAGEWAYS

BACKGROUND OF THE INVENTION

1. Field of the Invention

The present invention relates to portable, removable security gates and barriers (hereinafter, these will collectively be referred to as "gates") of the type temporarily installed in hallways and doorways of buildings for the purpose of preventing children and pets from passing into areas from which they are to be excluded. More particularly, the invention improves upon prior art security gates by adding an illuminated warning beacon enabling persons to see the gate during the night. This invention finds utility in any building or controlled exterior area wherein a security gate is placed, and where a person may possibly stumble over or walk into the security gate if the latter is not visible due to darkness.

2. Description of the Prior Art

Security gates are employed from time to time to prevent children and pets from gaining access to certain areas within a household. A security gate normally has apparatus for temporary and removable engagement of wall and door jamb surfaces for mounting. The security gate may remain in place for days, weeks, or months during a period when it is desired to control access of children and pets to specific portions of a building. If a security gate remains in place overnight, or during other conditions when it is obscured by darkness, then it is possible for people to walk into or stumble over the gate. This may arise due to forgetfulness or because a visitor to the house is unfamiliar with the security gate.

In many cases, little serious injury or damage ensues. However, in some situations, injury can potentially be severe. An example is a safety gate placed at the top of a flight of stairs. Should a person fall over or past the security gate, he or she could possibly fall down the flight of stairs. Potential consequences of such an occurrence are extreme.

Apart from hazard of injury and the nuisance of being obliged to reinstall the security gate, a person walking into the gate may cause damage to the building. It is an easy matter for the apparatus engaging a building wall or door jamb to chip paint or to gouge a hole or scratch into an architectural finish such as paint.

The prior art has provided security gates with various amenities. U.S. Pat. No. 5,437,115, issued to T. Brent Freese et al. on Aug. 1, 1995, U.S. Pat. No. 5,457,914, issued to Marvin B. Johnson on Oct. 17, 1995, U.S. Pat. No. 5,535,552, issued to Carl M. Stern on Jul. 16, 1996, and U.S. Pat. No. 5,809,694, issued to Mark Anthony Postans on Sep. 22, 1998, all illustrate security gates which are used to control access within buildings. In each case, the subject security gate lacks an illuminated beacon as seen in the present invention, and controls and power supply associated with the novel security gate.

None of the above inventions and patents, taken either singly or in combination, is seen to describe the instant invention as claimed.

SUMMARY OF THE INVENTION

The present invention improves upon security gates by providing an illuminated beacon so that a security gate may be seen at night and during other conditions of darkness. The improved security gate has both manual and automatic control features activating and inhibiting operation of the illuminated beacon. Illumination emanates from one or more fixtures mounted on the gate. In various embodiments, the fixture illuminates the gate itself or transmits a visible signal away from the gate, or several fixtures both illuminate the gate and also transmit a visible signal. The illumination beacon warns passers by of the presence of the gate regardless of the nature of the beacon. Either type of beacon may constantly be on or may flash intermittently.

The beacon is controlled by manual control, automatic control, or both. Operation of the beacon is inhibited in two embodiments by a photoelectric cell, which enables operation only in dark conditions, or by a programmable timer. In further embodiments, the beacon may normally remain off, illuminating responsive to detection of motion by an integral motion detector. Intensity of light may be controlled manually in discrete steps or progressively by a dimmer switch.

The barrier itself may be of any known type. Illustratively, it may comprise a fixed barrier that permanently obstructs a walkway, doorway, corridor, or the like as long as it is in place. As an alternative to a fixed barrier, the barrier may be the pass-through type comprising a gate. The gate may comprise a single panel which engages two opposed vertical surfaces by pressure. This type of gate will be called a pressure mounted gate. Alternatively, it may be of a type having parallel sliding panels which open to allow passage. In a further alternative, the gate may have a telescoping or scissors action, expansible barrier. In still another alternative, the gate may have a panel which rotates about a generally vertical axis.

The gate may have diverse apparatus for holding itself in place other than being horizontally expansible. For example, it may have eyes which receive fasteners which are driven into a wall or other vertical environmental surface. This type will be called a wall mounted gate. The gate is modified from conventional construction to contain one or more batteries, lighting fixtures, and controls. The controls optionally include a remote controller to enable the beacon to be controlled remotely.

Accordingly, it is one object of the invention to render a security gate visible in dark conditions.

It is another object of the invention to provide a security gate with an illuminated beacon.

Yet another oject of the invention is to operate the illuminated beacon by an external power supply.

It is a further object of the invention to control when the illuminated beacon operates.

Still another object of the invention is to operate the beacon automatically under dark conditions.

A further object of the invention is to operate the beacon when a person or animal is moving in the vicinity of the novel gate.

An additional object of the invention is that the gate have its own power supply and controls carried thereon.

Still a further object of the invention is selectively to illuminate the gate and to project a visible signal warning of the presence of the gate.

Yet another object of the invention is to control intensity of the beacon.

It is another object of the invention to operate the illuminated beacon by a remote control.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
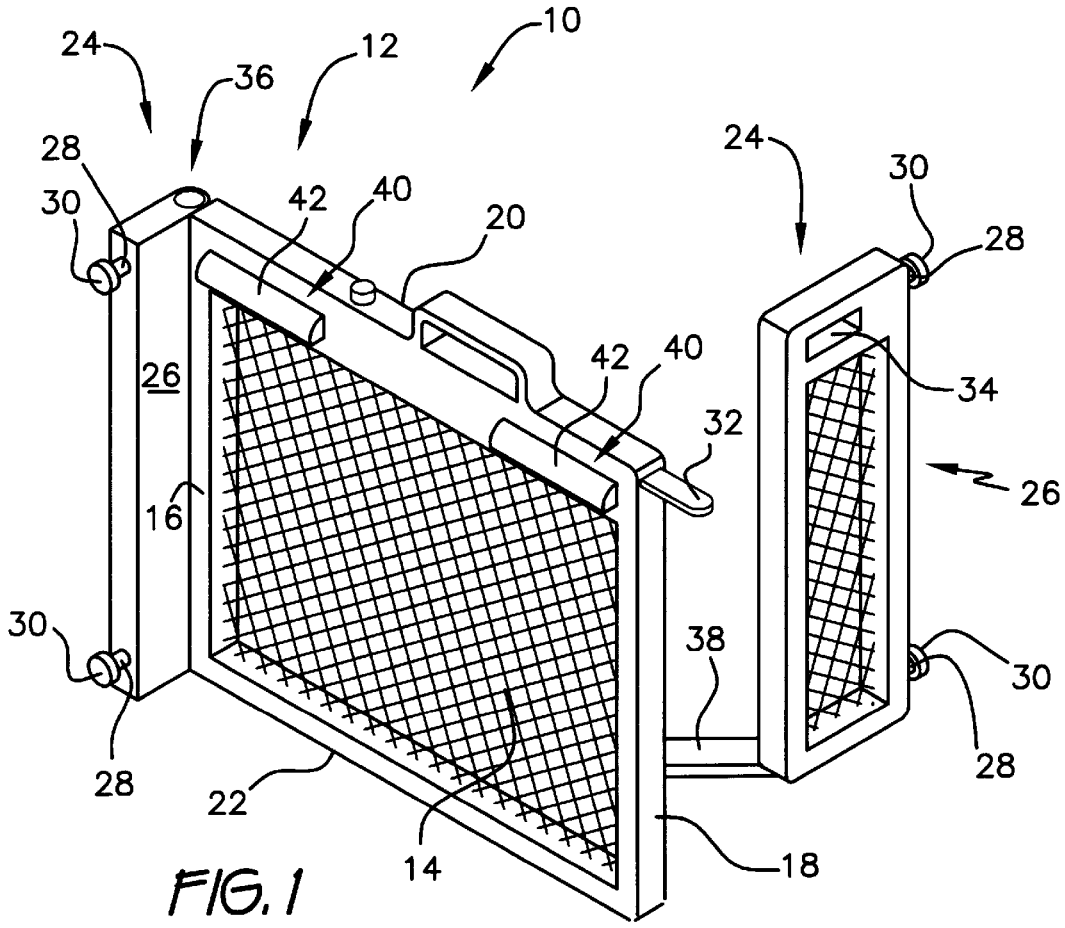
FIG. 1 is a perspective view of one embodiment of the invention.

FIG. 1 of the drawings shows an illuminated, portable, removable self-contained safety barrier 10 of the type employed for obstructing a passageway (not shown). Passageways that are controlled by safety barrier 10 are typically corridors, doorways and other points along areas intended for human occupancy and use. Such passageways are bounded by walls, partitions, and other structural or architectural features which constrain people to travel along the passageway but not to depart laterally therefrom.

For the purposes of this invention, a safety barrier may be either of the type permanently obstructing a passageway as long as the safety barrier is installed along the passageway, or alternatively could be a device intended to accommodate authorized passage such as a remote controlled security gate. In most cases, passage requires merely the ability to open the safety barrier, as safety barriers are typically intended to deny passage to children and pets. Safety barriers enabling passage include those having a panel which pivots about a vertical axis, those which expand to obstruct a passageway but can be compressed to create an opening or gap, and those having parallel upright panels which telescope to create an opening or gap. The novel improvements are equally applicable to all varieties of safety barriers.

Safety barriers encompassed by the present invention share the following structure. This structure includes a frame, such as that indicated at 12. Frame 12 supports a barrier panel 14 which may be solid or partially open to pass air and light. Barrier panel 14 may be rigid and capable of self-support so that a separate frame is not required. Alternatively, panel 14 may be flexible or resilient. Regardless of the precise nature of frame 12 and barrier panel 14, barrier panel 14 is supported in vertical orientation by frame 12. Frame 12 further comprises vertical channels 16, 18 and horizontal upper channel 20 and horizontal lower channel 22.

Safety barrier 10 of the type shown in FIG. 1 is intended to be easily installed and removable. Barrier 10 has mounting apparatus 24 disposed to mount frame 12 in an erect position to at least one environmental surface (not shown). In most cases, safety barrier 10 is supported by two walls, one on each side of the controlled passageway. In the embodiment of FIG. 1, mounting apparatus 24 includes a vertical post 26 and screws 28 threadedly supported in vertical post 26. Each screw 28 has a broad head 30 which contacts a wall of a corridor when screw 28 is turned such that head 30 moves away from its associated post 26.

Barrier panel 14 is pivotally supported on one post 26 and latches to the other post 26 by a tongue 32 which is received in a suitable receptacle 34. Receptacle 34 will be understood to include apparatus for releasably retaining tongue 32 when tongue 32 enters receptacle 34. Pivotal support of barrier panel 14 is accomplished by a suitable hinge or journaling arrangement indicated at 36. In the embodiment of FIG. 1, posts 26 are joined by a strut 38 which is firmly fixed to both, thereby preventing posts 24 from deflecting unduly when screws 28 expand such that safety barrier 10 becomes wedged between two opposing walls.

In most cases, safety barrier 10 has expansible members such as screws 28 which can be adjusted to contact or operably engage the walls or other fixed, permanent, generally vertical environmental surfaces, thereby supporting safety barrier by wedging. However, other mounting elements may be substituted for screws 28. Illustratively, safety barrier 10 may have elements (not shown) which project laterally from safety barrier 10 by cam action or other actuation schemes to contact the supporting walls. In a further alternative, projecting eyes (not shown) for receiving fasteners (not shown) may be driven into the supporting walls.

Thus far, features of safety barrier 10 are generally conventional. Safety barrier 10 departs from prior art barriers in that it has integral illumination for safety purposes. The invention also includes an electrically operated illumination source such as lamps 40 supported on frame 12. Lamps 40 have reflective covers 42 disposed to reflect light downwardly onto the front side of barrier panel 12. As employed herein, "front" is for semantic designation of one of the broad or large ends or faces of barrier panel 12. The rear or opposed large end or face of barrier panel 12 could also be illuminated by additional lamps (not shown) or by a different arrangement which will be described hereinafter.

Figure 2:
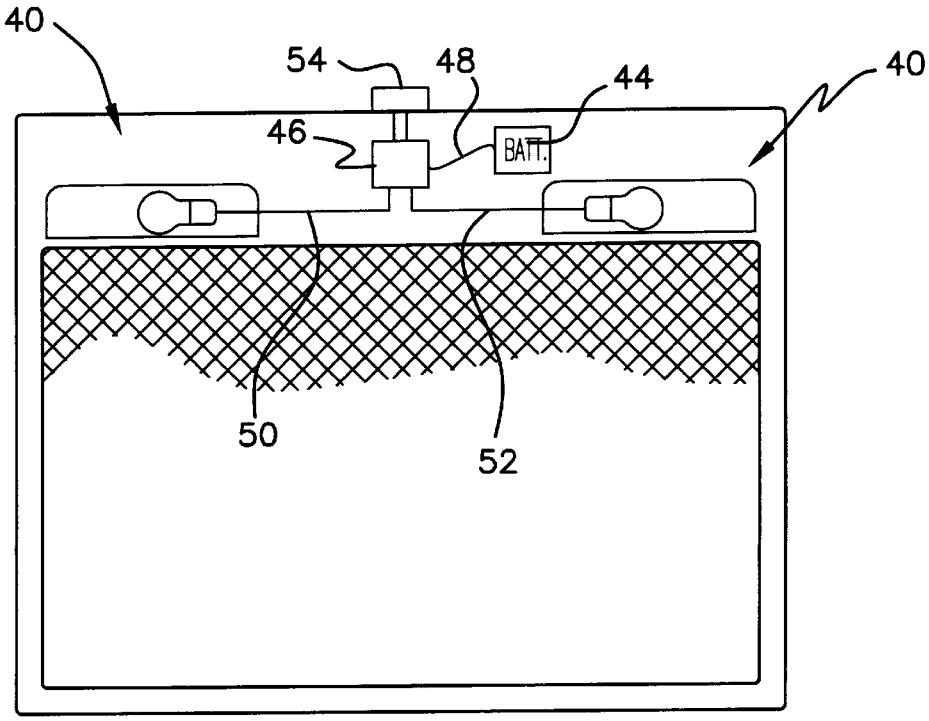
FIG. 2 is a diagrammatic, front elevational view of the center the embodiment of FIG. 1.

FIG. 2 shows the electrical system which operates lamps 40. The electrical system includes a source of electrical power such as battery 44, a control switch 46, and electrical conductors 48, 50, 52 connecting lamps 40 to battery 44. Conductors 48, 50, 52 will be understood to include the number of separate conductors required to accomplish the recited functions, even though they are depicted as a single element. A control knob 54 accessible from the exterior of safety barrier 10 operates switch 46. Switch 46 may turn lamps 40 on and off if desired. Alternatively, switch 46 may merely control intensity of light generated by lamps 40, leaving on-off control to other components. In the latter case, switch 46 may be a dimmer switch arranged to vary illumination of said illumination source in a continuous, progressive manner. Alternatively, switch 46 could be a three position switch arranged to limit illumination to three different levels. Both dimmer switches and three position switches and their circuitry are known, and will not be further described herein.

Figure 4:
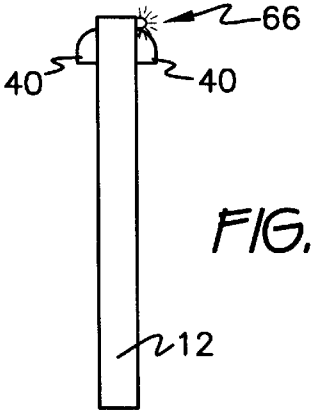
FIGS. 3 and 4 are end elevational views of alternative embodiments of the invention.
Figure 3:
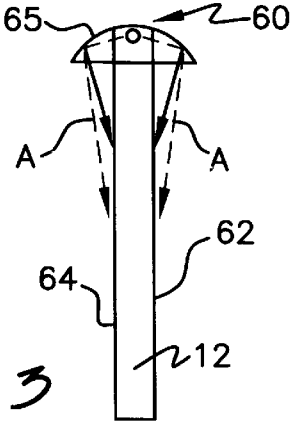

FIG. 3 illustrates how a single lamp 60 may be employed to project light to both front and rear sides 62, 64 of barrier panel 12. Lamp 60 has a reflective cover 65 which overlaps both front and rear sides 62, 64, and is dimensioned and configured to reflect light as indicated by arrows A. In FIG. 4, an additional lamp 66 is configured to project light away from barrier panel 12. This arrangement provides a visual signal which signals presence of safety barrier 10 by relected illumination.

Figure 5:
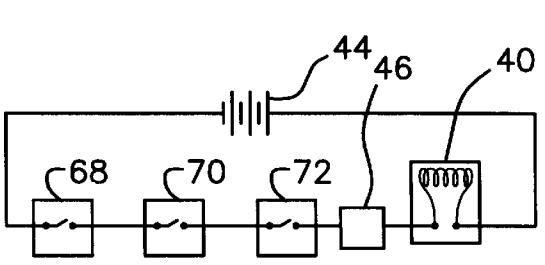
FIG. 5 is an electrical schematic illustrating a power and control scheme.

In preferred embodiments of the invention, the illumination source is operated by an automatic on-off controller. This automatic controller may take several forms, which may be employed singly or in any preferred combination. Referring now to FIG. 5, a programmable timer 68 operates the illumination source at predetermined times and extinguishes the illumination source at other times. In addition, a light sensitive switch 70 is included in the electrical system, and connects the illumination source to electrical power responsive to sensing a predetermined threshold of diminished ambient light levels. A motion sensor 72 is mounted on safety barrier 10 in a suitable location for sensing motion within a predetermined distance of itself, and makes electrical connection responsive to sensing motion within its range.

Figure 6:
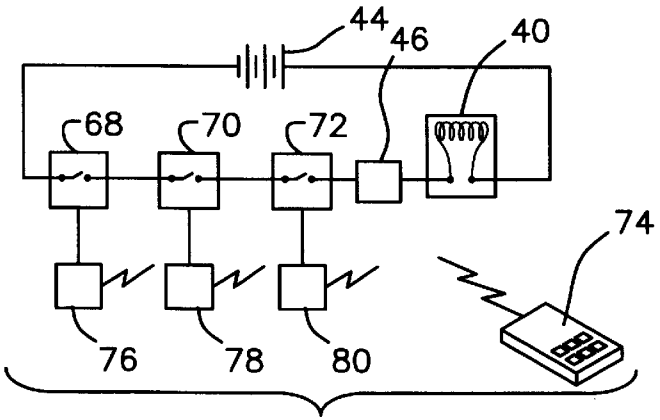
FIG. 6 is an electrical schematic illustrating remote control.

FIG. 6 illustrates an embodiment of the invention wherein a remote controller 74 generates command signals. A signal receiver 76, 78, or 80 is located at safety barrier 10. Each signal receiver is disposed to receive the command signals and to control the illumination source by its respective controller 68, 70, or 72 responsive to command signals generated by remote controller 74. Remote controller 74 may operate on radio frequency signals, may generate infrared signals, or may utilize any suitable radiant energy signals. Receivers 76, 78, 80 will be understood to be connected to power of battery 44, although this feature is omitted for brevity in the drawings. Remote controller 74 may also generate command signals for opening the barrier. This would be useful in the application of illumination of outdoor security gates or automatic garage doors.

Figure 7:
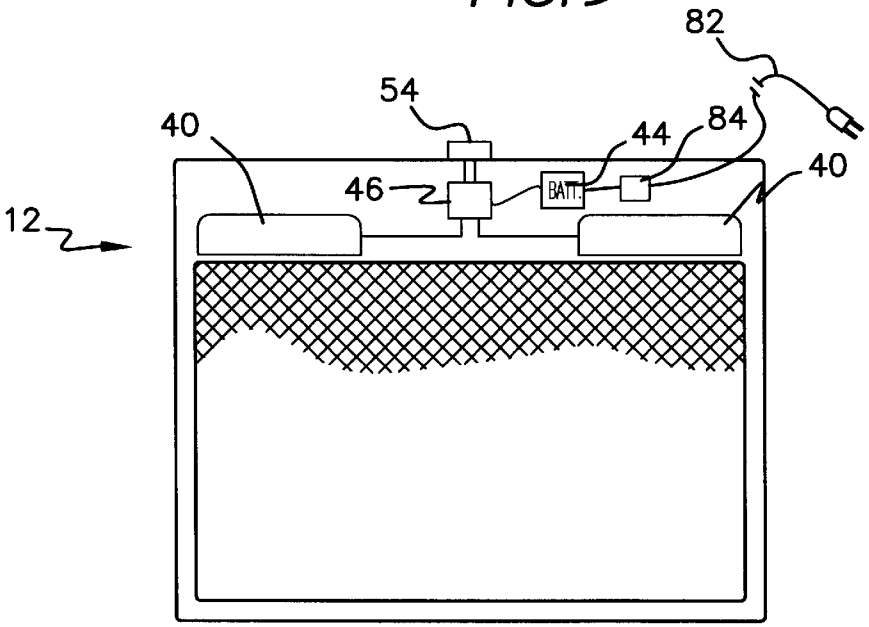
FIG. 7 is a diagrammatic, front view of still another embodiment of the invention.

As shown in FIG. 7, power may be derived from a plug and cord assembly 82. Plug and cord assembly 82 may be connected directly to lamp 40 and the electrical controls, or may be connected to a battery recharger 84, which is in turn connected to battery 44.

It is to be understood that the present invention is not limited to the embodiments described above, but encompasses any and all embodiments within the scope of the following claims.

I claim:

1. An illuminated portable, removable safety barrier for obstructing a passageway having a plurality of vertical environmental surfaces, comprising:

a frame;

a barrier panel supported in vertical orientation by said frame;

mounting apparatus disposed to mount said frame in an erect position to the environmental surfaces, comprising a first vertical post supporting a first screw including a broad head arranged to contact one of the environmental surfaces when said first screw is turned and a second vertical post supporting a second screw including a broad head arranged to contact another one of the environmental surfaces when said second screw is turned;

an electrically operated illumination source supported on said frame, wherein said barrier panel has a front side and said illumination source is disposed to project light at least onto said front side of said barrier panel; and an electrical system including a battery carried on said safety barrier and electrical conductors connecting said illumination source to said battery;

wherein said safety barrier is self-contained and can be installed to and removed from the environmental surfaces as a unitary assembly by said mounting apparatus.

2. The safety barrier according to claim 1, further comprising an automatic on-off controller disposed to operate said illumination source at predetermined times and to extinguish said illumination source at other times.

3. The safety barrier according to claim 2, wherein said automatic on-off controller comprises a light sensitive switch disposed to connect said illumination source to electrical power responsive to sensing a predetermined threshold of diminished ambient light levels.

4. The safety barrier according to claim 2, wherein said automatic on-off controller comprises a programmable timer disposed to connect said illumination source to electrical power at the predetermined times and to disconnect said illumination source from electrical power at other times.

5. The safety barrier according to claim 2, wherein said automatic on-off controller comprises a motion sensor disposed to connect said illumination source to electrical power responsive to sensing motion within a predetermined distance of said motion sensor.

6. The safety barrier according to claim 1, further comprising a manual controller disposed to control intensity of said illumination source.

7. The safety barrier according to claim 6, wherein said manual controller is arranged to limit illumination to three different levels.

8. The safety barrier according to claim 6, wherein said manual controller is arranged to vary illumination of said illumination source in a continuous, progressive manner.

9. The safety barrier according to claim 1, wherein said electrical system includes a battery charger connected to said battery and a cord and plug assembly connected to said battery charger.

10. The safety barrier according to claim 1, further comprising a remote controller generating command signals and a signal receiver located at said safety barrier, wherein said signal receiver receives the command signals and controls said illumination source responsive to command signals generated by said remote controller.

11. An illuminated portable, removable safety barrier for obstructing a passageway having a plurality of vertical environmental surfaces, comprising:

a frame;

a barrier panel supported in vertical orientation by said frame;

mounting apparatus disposed to mount said frame in an erect position to the environmental surfaces, comprising a first vertical post supporting a first screw including a broad head arranged to contact one of the environmental surfaces when said first screw is turned and a second vertical post supporting a second screw including a broad head arranged to contact another one of the environmental surfaces when said second screw is turned;

an electrically operated illumination source supported on said frame, wherein said barrier panel has a front side and said illumination source is disposed to project light at least onto said front side of said barrier panel;

an electrical system including a battery carried on said safety barrier, a battery charger connected to said battery, a cord and plug assembly connected to said battery charger, and electrical conductors connecting said illumination source to said battery;

an automatic on-off controller disposed to operate said illumination source at predetermined times and to extinguish said illumination source at other times, wherein said automatic on-off controller comprises a light sensitive switch disposed to connect said illumination source to electrical power responsive to sensing a predetermined threshold of diminished ambient light levels, a programmable timer disposed to connect said illumination source to electrical power at the predetermined times and to disconnect said illumination source to electrical power at other times, and a motion sensor disposed to connect said illumination source to electrical power responsive to sensing motion within a predetermined distance of said motion sensor;

a manual controller disposed to control intensity of said illumination source, wherein said manual controller is arranged to limit illumination to three different levels and to vary illumination of said illumination source in a continuous, progressive manner; and a remote controller disposed to generate command signals and a signal receiver located at said safety barrier, wherein said signal receiver is disposed to receive the command signals and to control said illumination source responsive to command signals generated by said remote controller.

* * * * *